US008188658B2

(12) United States Patent
Auer et al.

(10) Patent No.: US 8,188,658 B2
(45) Date of Patent: May 29, 2012

(54) TWO-FILAMENT LAMP

(75) Inventors: Frank Auer, Herbrechtingen-Bolheim (DE); Gerhard Behr, Altheim (DE); Peter Helbig, Sontheim/Brenz (DE); Christian Seichter, Herbrechtingen (DE); Klaus Wittmann, Sontheim (DE); Sascha Zelt, Beimerstetten (DE)

(73) Assignee: Osram AG, Munich (DE)

( * ) Notice: Subject to any disclaimer, the term of this patent is extended or adjusted under 35 U.S.C. 154(b) by 308 days.

(21) Appl. No.: 12/448,331

(22) PCT Filed: Dec. 10, 2007

(86) PCT No.: PCT/EP2007/063618

§ 371 (c)(1),
(2), (4) Date: Jun. 17, 2009

(87) PCT Pub. No.: WO2008/074684

PCT Pub. Date: Jun. 26, 2008

(65) Prior Publication Data

US 2010/0039017 A1 Feb. 18, 2010

(30) Foreign Application Priority Data

Dec. 20, 2006 (DE) ..... 10 2006 060 419

(51) Int. Cl.
*H01K 1/00* (2006.01)

(52) U.S. Cl. ..... 313/580; 313/115; 313/331; 313/333; 313/623; 313/624; 445/27

(58) Field of Classification Search ..... 313/316, 313/331, 333, 623, 624, 115, 580; 445/27
See application file for complete search history.

(56) References Cited

U.S. PATENT DOCUMENTS

| | | | |
|---|---|---|---|
| 3,774,064 | A | 11/1973 | Vause |
| 5,850,124 | A | 12/1998 | Hasegawa et al. |
| 2006/0091775 | A1 | 5/2006 | Auer et al. |

FOREIGN PATENT DOCUMENTS

| | | | |
|---|---|---|---|
| DE | 2 118061 | | 10/1971 |
| DE | 73 20 839 | U | 11/1974 |
| EP | 0 812 004 | A2 | 12/1997 |
| EP | 1 667 205 | A2 | 6/2006 |

*Primary Examiner* — Peter Macchiarolo
*Assistant Examiner* — Mary Ellen Bowman
(74) *Attorney, Agent, or Firm* — Holtz, Holtz, Goodman & Chick, PC

(57) ABSTRACT

Disclosed is a lamp, particularly for a vehicle headlight, comprising two spiral-wound filaments which are retained by three feeders within a bulb that is inserted into a base. The feeders are arranged on top of one another when the lamp is adequately oriented. A tail of the first spiral-wound filament is connected to a dimming cap, said tail being located at a distance from the base, while a tail of the second spiral-wound filament is connected to the central feeder, said tail being close to the base. The second filament tail that faces away and is located at a distance from the base is connected to the upper feeder. According to the invention, the lower feeder is connected to the dimming cap by means of an end, some sections of which are angled away from a longitudinal axis of the lamp.

8 Claims, 2 Drawing Sheets

TWO-FILAMENT LAMP

This application is a U.S. National Phase Application under 35 USC 371 of International Application PCT/EP2007/063618, filed Dec. 10, 2007, which is incorporated herein in its entirety by this reference.

TECHNICAL FIELD

The invention relates to a lamp, in particular for a vehicle headlight, having two incandescent filaments that are held by three supply lead wires inside a lamp vessel inserted into a base, the supply lead wires being arranged one above another, given suitable alignment of the lamp, an outgoing filament line, remote from the base, of the first incandescent filament being connected to an anti-dazzle device, and an outgoing filament line, near the base, of the second incandescent filament being connected to the middle supply lead wire, and the outgoing filament line, averted from and remote from the base, being connected to the upper supply lead wire.

PRIOR ART

Such a lamp is disclosed, for example, in EP 1 667 205 A2 by the applicant. These conventional vehicle lamps have a transparent lamp vessel that is sealed at one end by means of a pinch seal and in whose interior two incandescent filaments are arranged which are used, for example, to generate a high beam and a daytime running light or a high beam and a passing beam. The outgoing filament lines of the incandescent filaments are provided with a welding aid and are connected to three supply lead wires directly or via an anti-dazzle device. The supply lead wires are arranged one above another in a common plane given a suitable alignment of the lamp, one incandescent filament being held by the lower and the upper supply lead wires, and the second incandescent filament being fixed by means of the upper and the middle supply lead wires offset in a fashion parallel to the axis of the first incandescent filament and above the first incandescent filament. An outgoing filament line, remote from the base, of the first incandescent filament is connected to the anti-dazzle device, and an outgoing filament line, near the base, of the second incandescent filament is connected to the middle supply lead wire, the second outgoing filament line, averted from the base and remote from it, being connected to the upper supply lead wire.

It is a disadvantage in such lamps that the supply lead wires arranged offset in parallel in a plane necessitate a large width of pinch seal that is necessarily accompanied by an outlay on production engineering.

SUMMARY OF THE INVENTION

It is the object of the invention to provide a lamp that renders an improved filament arrangement possible in conjunction with a minimum outlay on production engineering.

This object is achieved by a lamp, in particular for a vehicle headlight, having two incandescent filaments that are held by three supply lead wires inside a lamp vessel inserted into a base, the supply lead wires being arranged one above another, given suitable alignment of the lamp, an outgoing filament line, remote from the base, of the first incandescent filament being connected to an anti-dazzle device, and a first outgoing filament line, near the base, of the second incandescent filament being connected to the middle supply lead wire, and the second outgoing filament line, averted from and remote from the base being connected to the upper supply lead wire, the lower supply lead wire being connected to the anti-dazzle device via an end angled away, at least in some sections, from a lamp longitudinal axis. Particularly advantageous designs of the invention are described in the dependent claims.

The above-named suitable alignment of the lamp is illustrated in FIG. 1. It corresponds to a preferred operating position of the inventive lamp. To facilitate understanding, the terminology used here to describe the invention is linked to this alignment of the lamp, as shown in FIG. 1. However, the inventive lamp can also be operated in any other desired operating positions. In the case of the inventive solution, by contrast with the prior art in accordance with EP 1 667 205 A2, the lower supply lead wire not only runs parallel to the lamp longitudinal axis, but is connected to the anti-dazzle device via an end angled away, at least in some sections, from a lamp longitudinal axis. Consequently, the base-side ends of the supply lead wires arranged in a common plane run at a reduced spacing from one another and the width of the pinch seal is thereby minimized.

In order to minimize light shadow effects by the supply lead wires, in particular by the middle supply lead wire, in the case of a particularly preferred exemplary embodiment of the invention, one incandescent filament is held by the lower and the upper supply lead wires, and the second incandescent filament is fixed by means of the upper and the middle supply lead wires offset in a fashion parallel to the axis of the first incandescent filament and above the first incandescent filament.

In accordance with a particularly preferred exemplary embodiment of the invention, the end (34) of the supply lead wire (26) is substantially adapted to the contour of the anti-dazzle device (30). The mechanical strength of the connection between anti-dazzle device and supply lead wire is thereby further improved.

It is particularly advantageous in terms of production engineering when a base-side holding portion and/or an end portion of the supply lead wire run/runs approximately parallel to the lamp longitudinal axis. Because of the fact that the lower supply lead wire runs in parallel, at least in some sections, said wire can be produced and embedded in the pinch seal easily in terms of production engineering.

In a preferred design of the lamp, the middle supply lead wire is positioned obliquely, at least in some sections, to the lamp longitudinal axis. The degree of parallel offset between the two incandescent filaments can thereby be set within narrow limits.

The incandescent filaments are preferably spaced apart axially in such a way as to achieve for the second incandescent filament an emission angle $\alpha$ in the range from 60 to 80°, in particular from 63.5 to 72.5°. In particular, the incandescent filaments are spaced apart axially in such a way as to produce around the filament body axis of the incandescent filament an emission angle $\beta$ of at least 320° such that at most one supply lead wire is located in the beam path in all angular ranges resulting from the possible combinations of the emission angles $\alpha$ and $\beta$.

The invention can be applied advantageously to two-filament halogen lamps that serve for use in motor vehicle headlights.

BRIEF DESCRIPTION OF THE DRAWINGS

The invention is explained in more detail below with the aid of a preferred exemplary embodiment. In the drawing.

PREFERRED EMBODIMENT OF THE INVENTION

The invention is explained below with the aid of a lamp with a base at one end for a vehicle headlight. The inventive lamp is, however, in no way limited to such lamp types.

Figure 1:
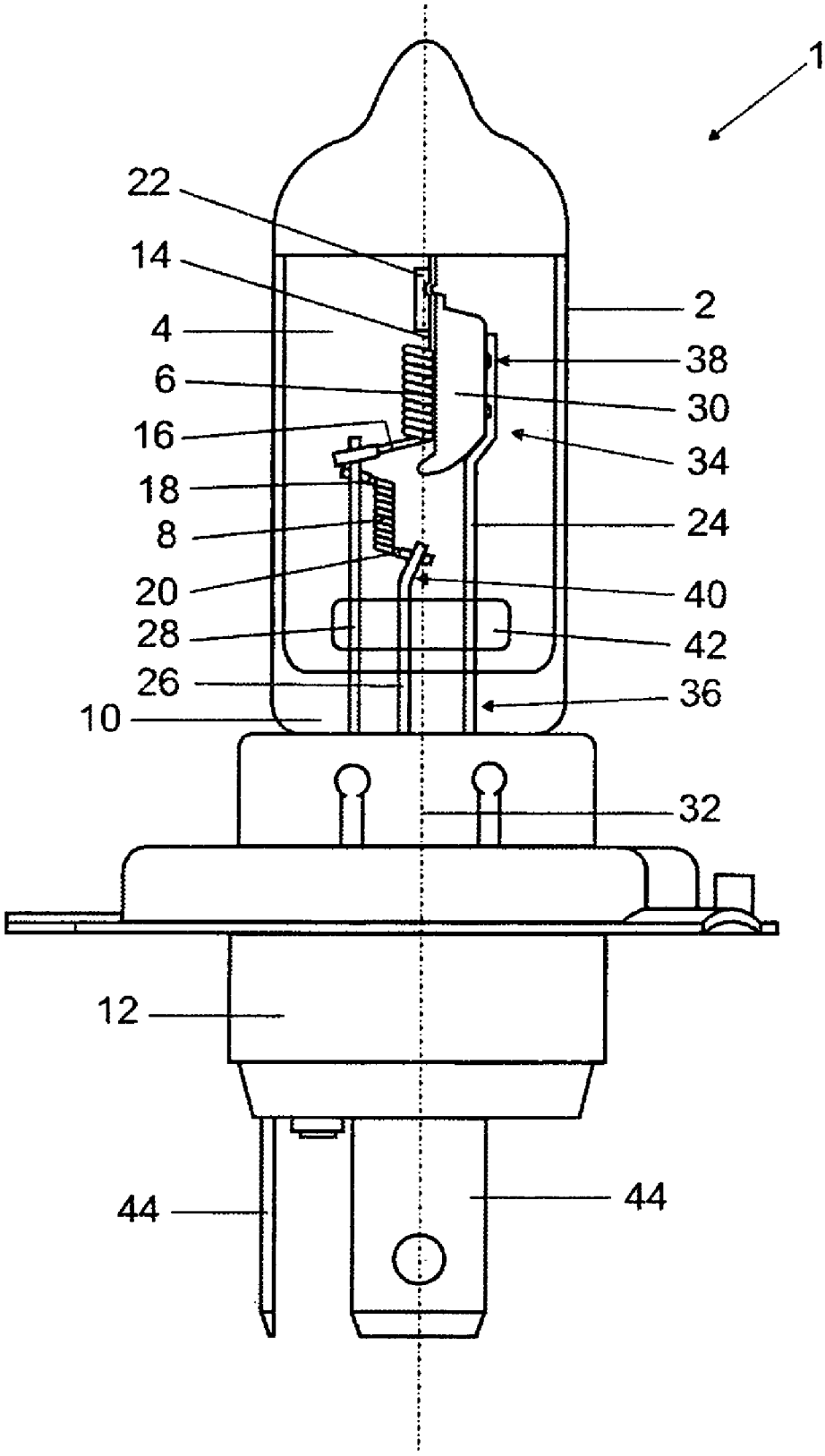
FIG. 1 shows a front view of an inventive lamp designed as a halogen incandescent lamp.

FIG. 1 shows a front view of an inventive lamp 1 designed as a halogen incandescent lamp, as is used in a vehicle headlight, for example. The lamp has a substantially cylindrical lamp vessel 2, in whose interior 4 there are arranged two incandescent filaments 6, 8 that are used, for example, to generate a high beam and a daytime running light or a high beam and a passing beam. The lamp vessel 2 is sealed via a pinch seal 10 at one end and inserted into a base 12. The outgoing filament lines 14, 16, 18, 20 of the incandescent filaments 6, 8 are respectively provided with a welding aid 22 and brought into electrical contact via supply lead wires 24, 26, 28. In the case of the illustrated alignment of the lamp 1, which corresponds to a preferred operating position of the inventive lamp 1 in the vehicle headlight, the supply lead wires 24, 26, 28 are arranged one above another, the outgoing filament line 14, remote from the base, of the incandescent filament 6 being connected to an anti-dazzle device 30 partially shielding said filament, and the outgoing filament line 20, near the base, of the second incandescent filament 8 connected to the middle supply lead wire 26, and the second outgoing filament line 18, averted from and remote from the base 12, being connected to the upper supply lead wire 28. According to the invention, the lower supply lead wire 24 is connected to the anti-dazzle device 30 via an end 34 angled away, at least in some sections, from a lamp longitudinal axis 32. Consequently, the base-side ends of the supply lead wires 24, 26, 28 arranged in a common plane run at a reduced spacing from one another and the width of the pinch seal 10 is thereby minimized. The end 34 of the supply lead wire 24 is substantially adapted to the contour of the anti-dazzle device 30. The mechanical strength of the connection between anti-dazzle device and supply lead wire is thereby further improved. It is particularly advantageous in terms of production engineering when a base-side holding portion 36 and/or an end portion 38 of the supply lead wire 24 run/runs approximately parallel to the lamp longitudinal axis 32. In order to minimize light shadow effects by the supply lead wires 24, 26, 28, in particular owing to the middle supply lead wire 26, the incandescent filament 6 is held by the lower supply lead wire 24 and the upper supply lead wire 28, and the second incandescent filament 8 is fixed by means of the upper supply lead wire 28 and the middle supply lead wire 26 offset in a fashion parallel to the axis of the first incandescent filament 6 and above the first incandescent filament 6. The second outgoing filament line 16 of the incandescent filament 6 is connected to the supply lead wire 28. An end portion 40 of the middle supply lead wire 26 is positioned obliquely to the lamp longitudinal axis 32. The degree of parallel offset between the two incandescent filaments 6, 8 can thereby be set within narrow limits. The supply lead wires 24, 26, 28 are fixed between two quartz glass webs 42, fused to one another, such that they are arranged in a common plane. Hard glass webs could be used instead of the quartz glass webs 42. The supply lead wires 24, 26, 28 are respectively connected in an electrically conducting fashion to a contact element designed as contact lug 44. The contact lugs 44 run in the direction of the supply lead wires 24, 26, 28, project from the base 12, and form the electrical connections of the halogen incandescent lamp 1.

Figure 2:
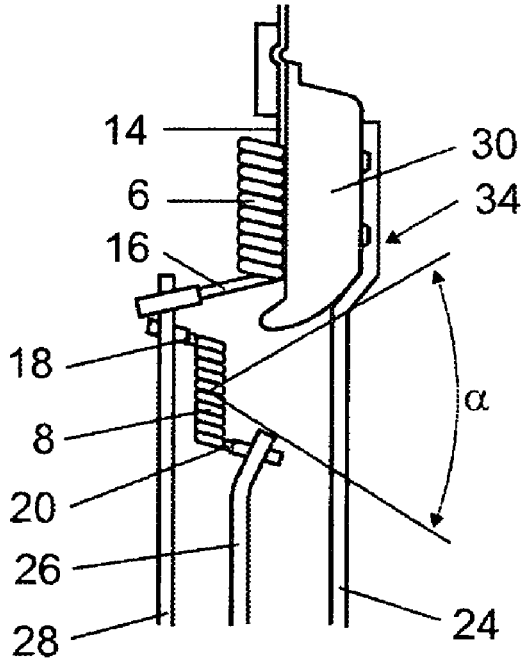
FIG. 2 shows a schematic of the frame design of the lamp from FIG. 1.

In accordance with FIG. 2, which is a schematic of the frame design of the lamp 1 from FIG. 1, the incandescent filaments 6, 8 are spaced apart axially in such a way as to achieve for the second incandescent filament an emission angle $\alpha$ in the range from 60 to 80°, in particular from 63.5 to 72.5°. No shadowing owing to the middle supply lead wire 26 or the anti-dazzle device 30 occurs in this range. In this variant of the invention, the middle supply lead wire 26 is positioned obliquely relative to the lamp longitudinal axis 32.

Figure 3:
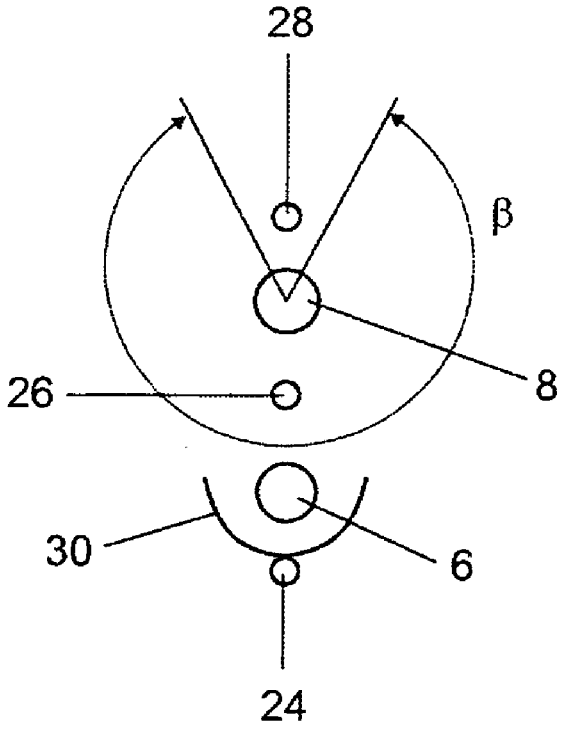
FIG. 3 shows a plan view of the frame design from FIG. 2.

FIG. 3 shows a plan view of the frame design from FIG. 2, in accordance with which the supply lead wires 24, 26, 28 and incandescent filaments 6, 8 are arranged in a common plane, an emission angle $\beta$ for the incandescent filament 8 of at least 324.6° being achieved. In all directions that are possible in the combination of the emission angles $\alpha$ and $\beta$ (see FIG. 2), at most one supply lead wire 24 lies in the beam path of the incandescent filament 8.

What is disclosed is a lamp 1, in particular for a vehicle headlight, having two incandescent filaments 6, 8 that are held by three supply lead wires 24, 26, 28 inside a lamp vessel 2 inserted into a base 12, the supply lead wires 24, 26, 28 being arranged one above another, given suitable alignment of the lamp 1, an outgoing filament line 14, remote from the base, of the first incandescent filament 6 being connected to an anti-dazzle device 30, and an outgoing filament line 20, near the base, of the second incandescent filament 8 being connected to the middle supply lead wire 26, and the outgoing filament line (18), averted from and remote from the base 12, being connected to the upper supply lead wire 28. According to the invention, the lower supply lead wire 24 is connected to the anti-dazzle device 30 via an end 34 angled away, at least in some sections, from a lamp longitudinal axis 32.

The invention claimed is:

1. A lamp for a vehicle headlight, having two incandescent filaments that are held by three supply lead wires inside a lamp vessel inserted into a base, the supply lead wires being arranged one above another, given suitable alignment of the lamp, an outgoing filament line, remote from the base, of the first incandescent filament being connected to an anti-dazzle device, and an outgoing filament line, near the base, of the second incandescent filament being connected to the middle supply lead wire, and the outgoing filament line, averted from and remote from the base, being connected to the upper supply lead wire, wherein the lower supply lead wire is connected to the anti-dazzle device via an end angled away, at least in some sections, from a lamp longitudinal axis, and wherein said end of the lower supply lead wire is substantially adapted to the contour of the anti-dazzle device and comprises an inclined portion angled away from the lamp longitudinal axis and an end portion running parallel to the lamp longitudinal axis, wherein said inclined portion and said end portion rest against the anti-dazzle device.

2. The lamp as claimed in claim 1, in which the first incandescent filament is held by the lower and the upper supply lead wires, and the second incandescent filament is fixed by means of the upper and the middle supply lead wires offset in a fashion parallel to the axis of the first incandescent filament and above the first incandescent filament.

3. The lamp as claimed in claim 1, in which a base-side holding portion of the supply lead wire runs approximately parallel to the lamp longitudinal axis.

4. The lamp as claimed in claim 3, in which the middle supply lead wire is positioned obliquely, at least in some sections, to the lamp longitudinal axis.

5. The lamp as claimed in claim 4, in which the incandescent filaments are spaced apart axially in such a way as to achieve for the second incandescent filament an emission angle $\alpha$ in the range from 60 to 80°.

6. The lamp as claimed in claim 5, in which the incandescent filaments are spaced apart axially in such a way as to produce around the filament body axis of the second incandescent filament an emission angle $\beta$ of at least 320° such that at most one supply lead wire is located in the beam path in all angular ranges resulting from the possible combinations of the emission angles $\alpha$ and $\beta$.

7. The lamp as claimed in claim 1, in which the middle supply lead wire is positioned obliquely, at least in some sections, to the lamp longitudinal axis.

8. The lamp as claimed in claim 1, in which the incandescent filaments are spaced apart axially in such a way as to achieve for the second incandescent filament an emission angle $\alpha$ in the range from 60 to 80°.

* * * * *